US006523386B2

(12) United States Patent
Matsuoka

(10) Patent No.: US 6,523,386 B2
(45) Date of Patent: Feb. 25, 2003

(54) NEGATIVE-ANGLE FORMING DIE

(75) Inventor: Mitsuo Matsuoka, Hirakata (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/875,077

(22) Filed: Jun. 7, 2001

(65) Prior Publication Data

US 2002/0121122 A1 Sep. 5, 2002

(30) Foreign Application Priority Data

Mar. 5, 2001 (JP) ..... 2001-060168

(51) Int. Cl.[7] ..... B21D 5/04
(52) U.S. Cl. ..... 72/312; 72/387; 72/452.9
(58) Field of Search ..... 72/312–315, 452.9, 72/388, 387, 319

(56) References Cited

U.S. PATENT DOCUMENTS 6,230,536 B1 * 5/2001 Matsuoka ..... 72/313

FOREIGN PATENT DOCUMENTS

JP 3-5018 * 1/1991 ..... 72/452.9
JP 11-226672 * 8/1999

* cited by examiner

*Primary Examiner*—Daniel C. Crane
(74) *Attorney, Agent, or Firm*—Birch, Stewart, Kolasch & Birch, LLP

(57) ABSTRACT

The present invention provides a negative-angle forming die comprising a lower die half and an upper die half. The lower die half has an intrusion forming portion, a rotary cam, a slide cam, and an automatic retractor. The work is placed on the lower die half being formed by an intrusion forming portion of the rotary cam and an intrusion forming portion of the slide cam. The slide cam forms the work by sliding. The rotary cam has two ends each including a supporting shaft projecting therefrom. The supporting shafts are supported by the lower die half for rotatably supporting the rotary cam. The intrusion forming portion of the rotary cam has a lower portion formed with a receiving portion, a J-shaped lock bar having an engaging portion for engagement with the receiving portion being slidably disposed below the rotary cam, the lock bar being urged by a returning urge provider in a direction away from a forming direction, the slide cam being made capable of urging the lock bar in a direction of the intrusion forming by an urge provider providing an urge greater than the urge from the returning urge provider, for moving the lock bar against the urge from the returning urge provider thereby engaging the rotary cam with the lock bar at a time of the intrusion forming performed by the slide cam and the rotary cam.

5 Claims, 7 Drawing Sheets

NEGATIVE-ANGLE FORMING DIE

BACKGROUND OF THE INVENTION

The present invention relates to a negative-angle forming die for forming a sheet metal. Herein, the negative-angle forming die is used for a formation made at a location more inward of a lower die half than a straight downward stroke line of an upper die half.

The negatively angled forming of a work provided as a sheet metal into a shape having a portion more inward of the lower die half than the straight downward stroke line of the upper die half is generally performed by using a slide cam.

According to a prior-art intrusion forming process of the sheet metal work, the work is placed on the lower die half and the upper die half is lowered vertically. At this time a drive cam of the upper die half drives a driven cam of the lower die half, forming the work from a side. After the formation is completed and the upper die half is lifted, then the driving cam is retracted by a spring.

In the above arrangement, the driven cam slid onto the work from the side has a forming portion which is formed as a single piece in the same shape as the work as after the formation. The lower die half however, must allow the work to be taken out from the lower die half after the formation, and for this reason, a portion of the lower die half providing the intrusion formation must be made separable for retraction, or a rear portion thereof must be cut off so that the work can be moved forward and taken out. This does not pose a serious problem if the extent of the intrusion is small. However, the problem becomes serious if the extent of the intrusion is large, or if the work is to be formed into a long frame having a groove-like section such as in a formation of an automobile front pillar-outer from a sheet metal. Specifically, since the groove width of the work is so narrow, that if the portion of the lower die half corresponding to the groove is divided or cut off, it becomes impossible for the forming portion of the driven cam to form clearly. In addition, strength of the lower die decreases. Thus, it was impossible to perform a clear-shaped intrusion formation.

Further, a formed product sometimes has a twist or distortion, which must be corrected. However, for example, many automobile parts that provide the outer skin of the automobile, such as a side panel, fender, roof, bonnet, trunk lid, door panel, front pillar-outer and so on are formed to have a three-dimensional surface or line, and therefore it is practically impossible to make correction after the formation. In assembling the automobile sheet-metal parts, if there is a twist or distortion in the parts, it is difficult to fit the parts together. Without solving this problem, it was impossible to provide a high quality automobile sheet metal structure, and it was impossible to maintain a required level of product accuracy in the formed sheet metal products.

In order to solve the above-described problem, an arrangement was proposed, in which the straight downward stroke of the upper die half is converted to a rotary movement of a rotary cam to pivot to form the portion in the lower die half more inward than the straight downward stroke line of the upper die half. In this arrangement, after the forming operation, the rotary cam is pivoted back to a state where the completed work can be taken out of the lower die. This arrangement will be described in more detail.

Specifically, as shown in FIG. 4 to FIG. 7, this negative-angle forming die comprises a lower die half 102 including a supporting portion 101 on which a work W is placed and an upper die half 103 which is lowered straightly down onto the lower die half 102 to press thereby forming the work W. The lower die half 102 is rotatably provided with a rotary cam 106 supported in an upwardly opening axial groove 104. The groove 104 has a portion close to the supporting portion 101 formed with an intrusion forming portion 105 located more inward than a stroke line of the upper die half 103. The lower die half 102 rotatably supports a rotary cam 106. The upper die half 103 is provided with a slide cam 108 opposed to the rotary cam 106 and provided with an intrusion forming portion 107. The lower die half is further provided with an automatic retractor 109 which moves the rotary cam 106 back to the sate that allows the work W to be taken out of the lower die half 102 after the formation. The work W placed on the supporting portion 101 of the lower die half 102 is formed by the intrusion forming portion 105 of the rotary cam 106 and the intrusion forming portion 107 of the slide cam 108. The work W is formed by a rotary movement of the rotary cam 106 and a sliding movement of the slide cam 108. After the formation, the automatic retractor 109 pivots back the rotary cam 106, allowing the work W to be taken out of the lower die half 102.

Now, an operation of this negative-angle forming die will be described.

First, as shown in FIG. 4, the upper die half 103 is positioned at its upper dead center. At this stage, the work W is placed on the supporting portion 101 of the lower die half 102. The rotary cam 106 is held at its retracted position by the automatic retractor 109.

Next, the upper die half 103 begins to lower, and first, as shown in FIG. 5, a lower surface of the slide cam 108 makes contact with a pivoting plate 111 without causing the slide cam 108 to interfere with the intrusion forming portion 105 of the rotary cam 106, pivoting the rotary cam 106 clockwise as in FIG. 10, thereby placing the rotary cam 106 at a forming position. Then, a pad 110 presses the work W.

When the upper die half 103 continues to lower, the slide cam 108 which is under an urge outward of the die half begins a sliding movement as the sliding cam in a laterally leftward direction, against the urge from a coil spring 112.

This is a state shown in FIG. 6, where the intrusion forming portion 105 of the pivoted rotary cam 106 and the intrusion forming portion 107 of the slide cam 108 perform formation of the work W.

After the intrusion formation, the upper die half 103 begins to rise. The slide cam 108, which is urged outwardly of the die half by the coil spring 112, moves in a laterally rightward direction as in FIG. 7, and keeps rising without interfering with the work W as after the intrusion formation.

On the other hand, the rotary cam 106 is released from the holding by the slide cam 108, and therefore is pivoted in a leftward direction as in FIG. 7 by the automatic retractor 109. Thus, when the work W is taken out of the lower die half after the intrusion formation, the work W can be removed without interference with the intrusion forming portion 105 of the rotary cam 106.

According to the negative-angle forming process described above, the lower surface of the slide cam 108 urged by the coil spring 112 contacts the pivoting plate 111 urged by the coil spring 113 of the automatic retractor 109, rotating the rotary cam 106 in the clockwise direction to the shaping position, and thereafter, the pad 110 presses the work W. With this arrangement, urging force from the pad 110 to the work W is so strong that the work W under the formation can be slightly pivoted counterclockwise as in the figure. In another case, the urge of the coil spring 112 of the slide cam 108 is not well balanced with the urge of the coil spring 113 of the automatic retractor 109, resulting in a slight pivoting movement of the rotary cam 106 out of the predetermined position for the formation. These situations sometimes make impossible to form into an accurate curve. For example, it is sometimes impossible to provide a product of an accuracy level in the order of 1/100 mm, and it was sometimes impossible to achieve a high quality negative-angle formation.

Further, as will be understood from FIG. 4 through FIG. 7, the rotary cam 106 is supported by the lower die half 102 through direct contact of the cam's outer circumference except for the groove portion 104. With this structure, accurate and difficult machining must be made to the rotary cam 106 and the supporting portion (a bore having a generally circle section) of the lower die half 102 which supports the rotary cam 106.

Further, since most of the outer wall of the rotary cam 106 is used for support by the lower die half 102, the negative angle forming die tends to be large and expensive.

Now, in consideration of the background described above, the present invention aims to solve these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. The present invention aims to maintain the rotary cam at a predetermined forming position thereby providing a formed sheet metal product of a high quality. In order to achieve this object, the present invention provides a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, the intrusion forming portion of the rotary cam having a lower portion formed with a receiving portion, a J-shaped lock bar having an engaging portion for engagement with the receiving portion being slidably disposed below the rotary cam, the lock bar being urged by a returning urge provider in a direction away from a forming direction, the slide cam being made capable of urging the lock bar in a direction of the intrusion forming by an urge provider providing an urge greater than the urge from the returning urge provider, for moving the lock bar against the urge from the returning urge provider thereby engaging the rotary cam with the lock bar at a time of the intrusion forming performed by the slide cam and the rotary cam.

Further, in consideration of the background described above, the present invention aims to solve these problems: that slight pivoting movement makes a rotary cam out of a predetermined forming position, making an unwanted step in a curved surface of the work or making unable to form into an accurate curve; and it is difficult to provide a product of accuracy in the order of 1/100 mm is difficult; and that it is impossible to provide a formed sheet metal product of a high quality. The present invention aims to maintain the rotary cam at a predetermined forming position, thereby providing a formed sheet metal product if of a high quality. In order to achieve this object, according to the negative-angle forming die provided by the present invention, the rotary cam has an intrusion forming groove having an edge portion opposing the intrusion forming portion, formed with a supporting surface, and the slide cam is formed with a sliding surface for contact with the supporting surface at the time of the intrusion forming.

Further, in consideration of the background described above, the present invention aims to solve these problems: that slight pivoting movement makes a rotary cam out of a predetermined forming position, making an unwanted step in a curved surface of the work or making unable to form into an accurate curve; and it is difficult to provide a product of accuracy in the order of 1/100 mm is difficult; and that it is impossible to provide a formed sheet metal product of a high quality. The present invention aims to maintain the rotary cam at a predetermined forming position, thereby providing a formed sheet metal product of a high quality. In order to achieve this object, according to the negative-angle forming die provided by the present invention, the upper die half is provided with a driving cam for driving the slide cam provided in the lower die half.

Two sectional views of an automobile sheet-metal part before and after a formation by the negative-angle forming die according to the present invention.

[FIG. 2]

Figure 1A:
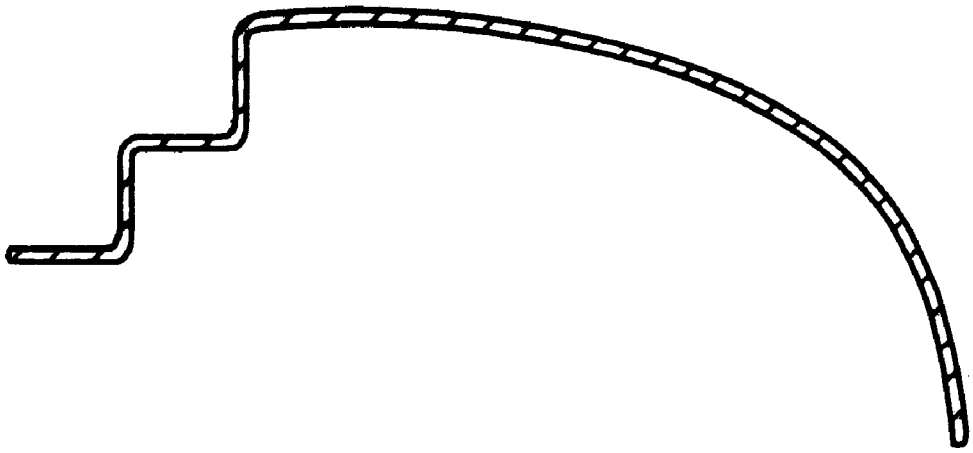
[FIGS. 1(*a*) and 1(*b*)]
Figure 1B:
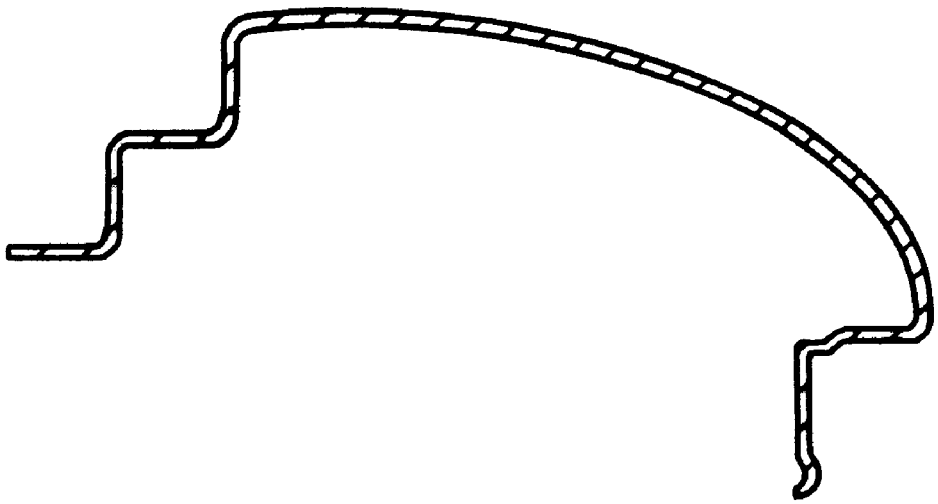

A sectional side view showing a state in which an upper die half for forming the sheet-metal part in FIG. 1 is at an upper dead center.

[FIG. 3]

A sectional side view showing a state in which the upper die half having formed the sheet-metal part in FIG. 1 is lowered to a lower dead center.

[FIG. 4]

A sectional side view of a prior art negative-angle forming die, with an upper die half thereof being at its upper dead center.

[FIG. 5]

Figure 4:
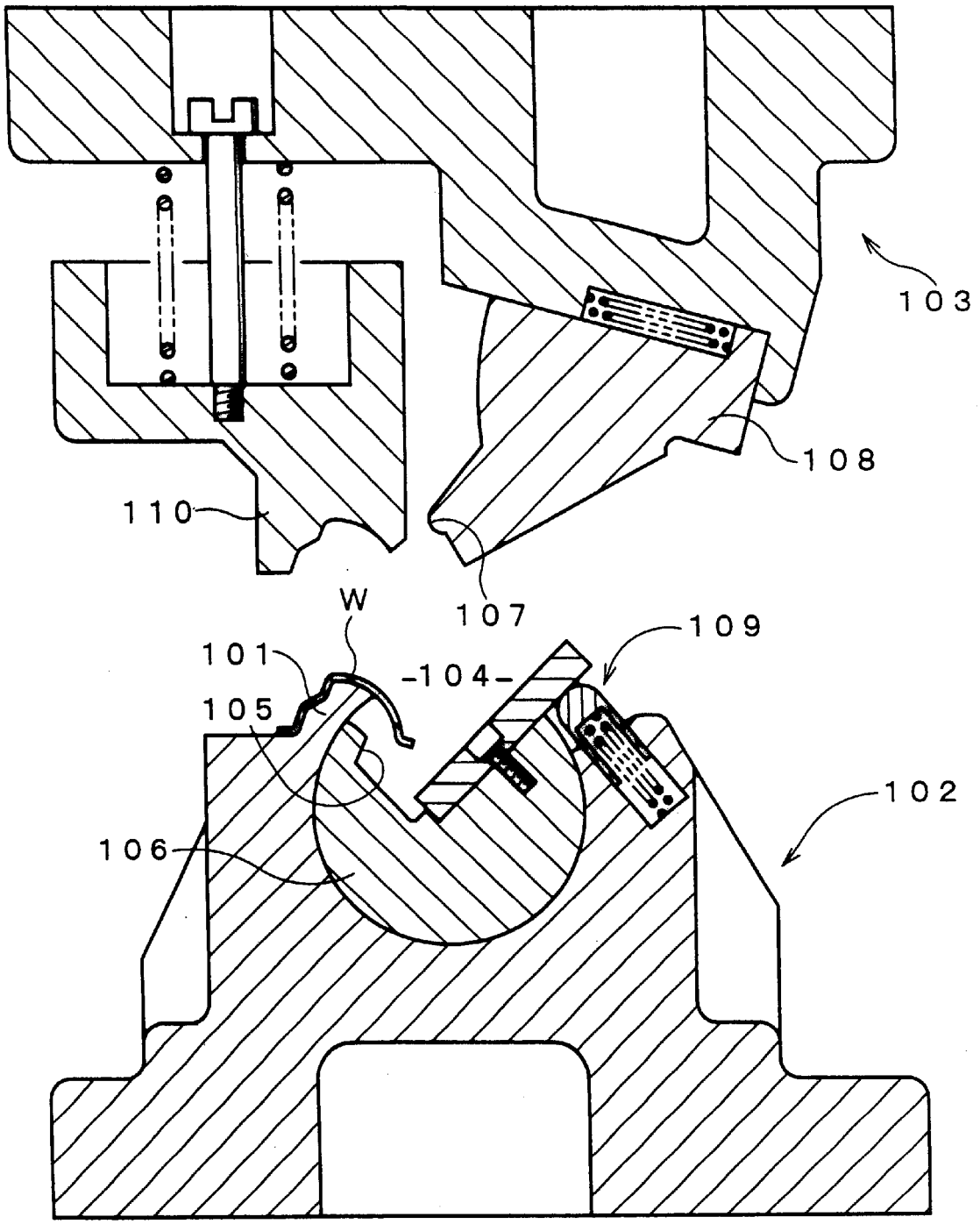
Figure 5:
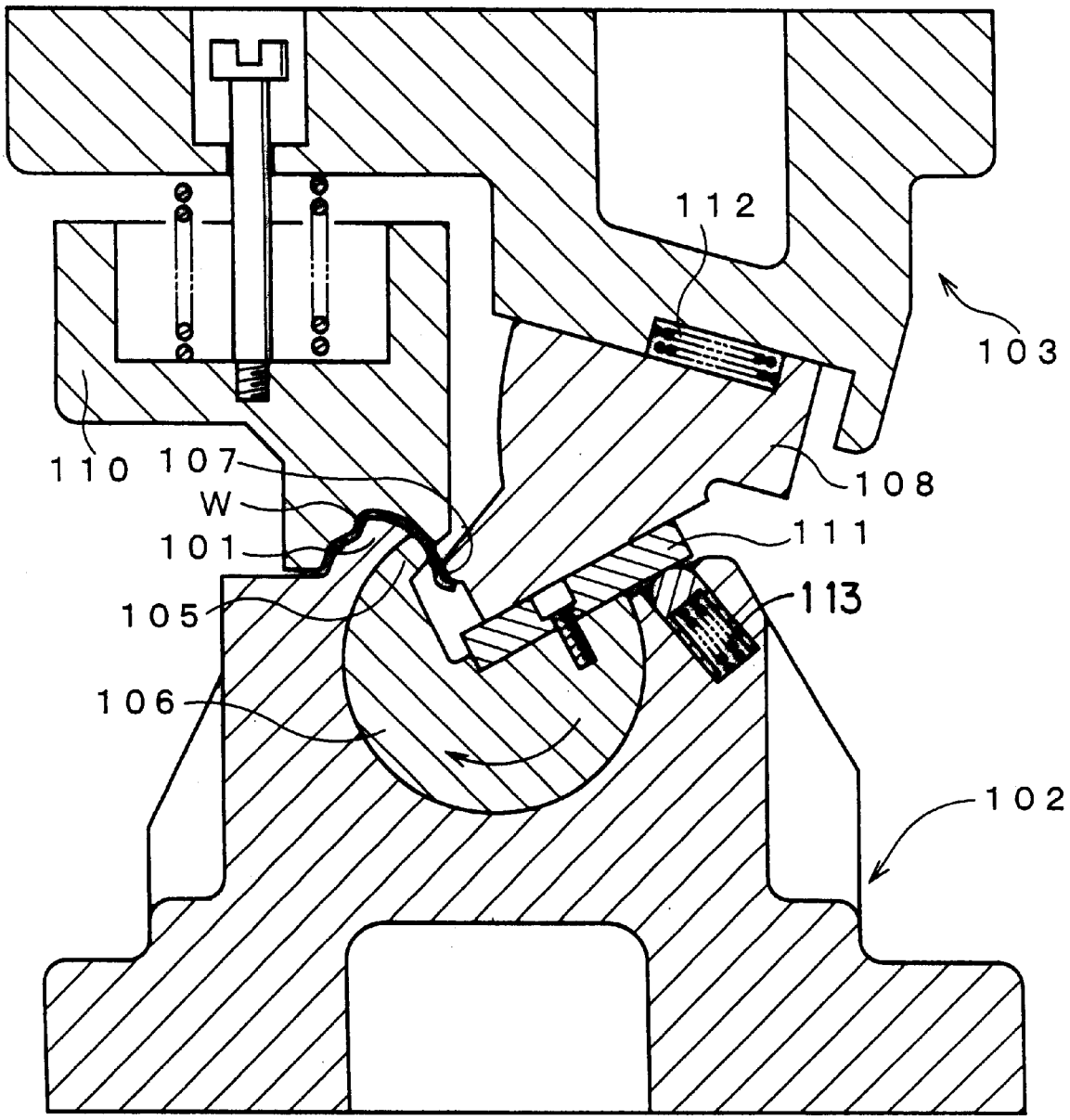
Figure 6:
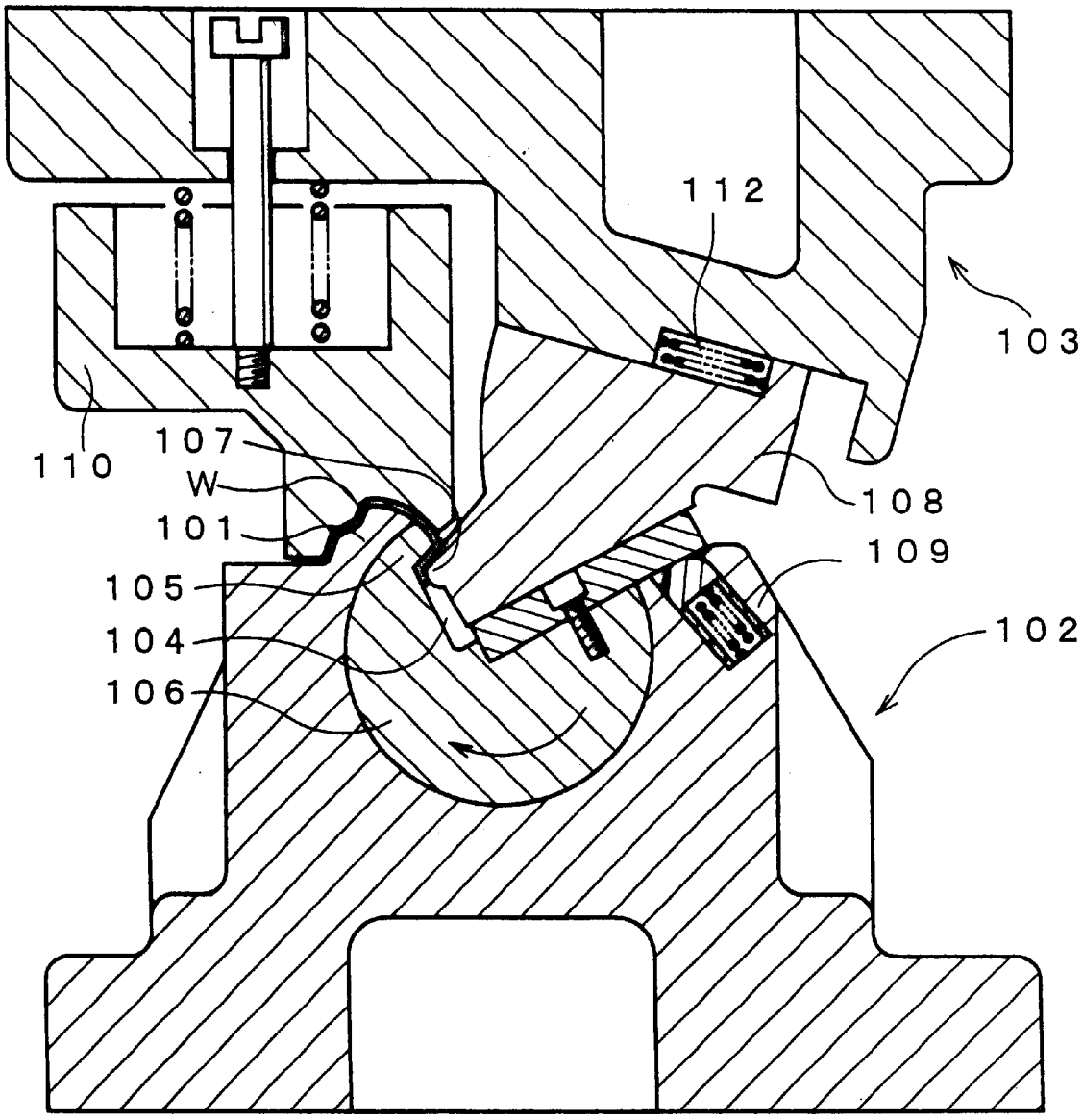
Figure 7:
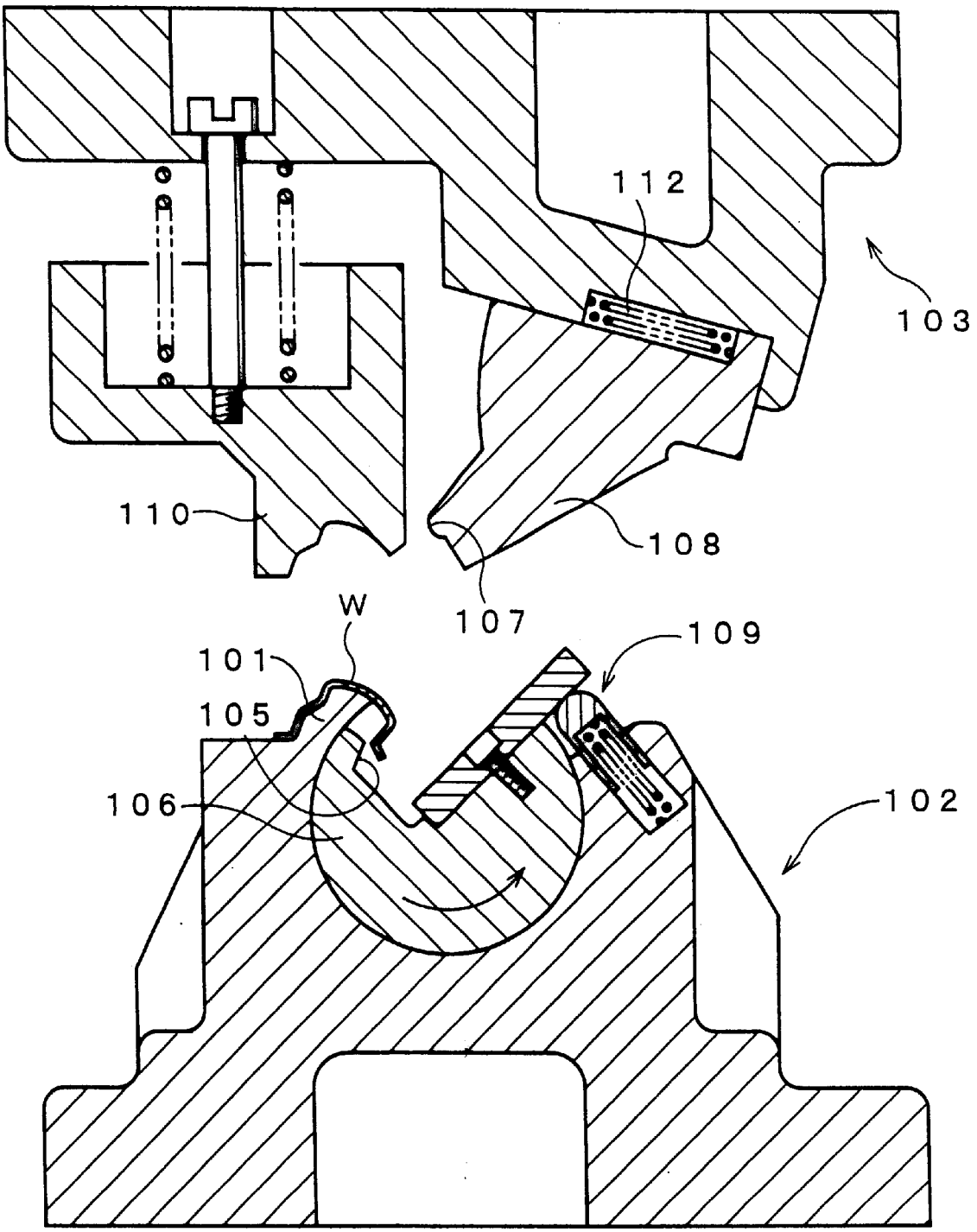

A sectional side view of the prior art negative-angle forming die in FIG. 4, with the upper die half in its downward stroke, beginning to contact a lower die half thereby making contact with a work.

[FIG. 6]

A sectional side view of the prior art negative-angle forming die in FIG. 4, with the upper die half being at its lower dead center.

[FIG. 7]

A sectional side view of the prior art negative-angle forming die in FIG. 4 as after the intrusion forming, with the upper die half lifted to its upper dead center.

EMBODIMENT

The present invention will now be described in detail, based on an embodiment shown in the attached drawings.

FIG. 1 shows sectional views of an automobile sheet-metal part before and after a formation by the negative-angle forming die. A work W shown in FIG. 1(*b*) has a lower portion shaped by an intrusion forming process.

It should be noted here that this part is formed to have a three-dimensional curved surface/line to provide an outer skin of the automobile.

Figure 2:
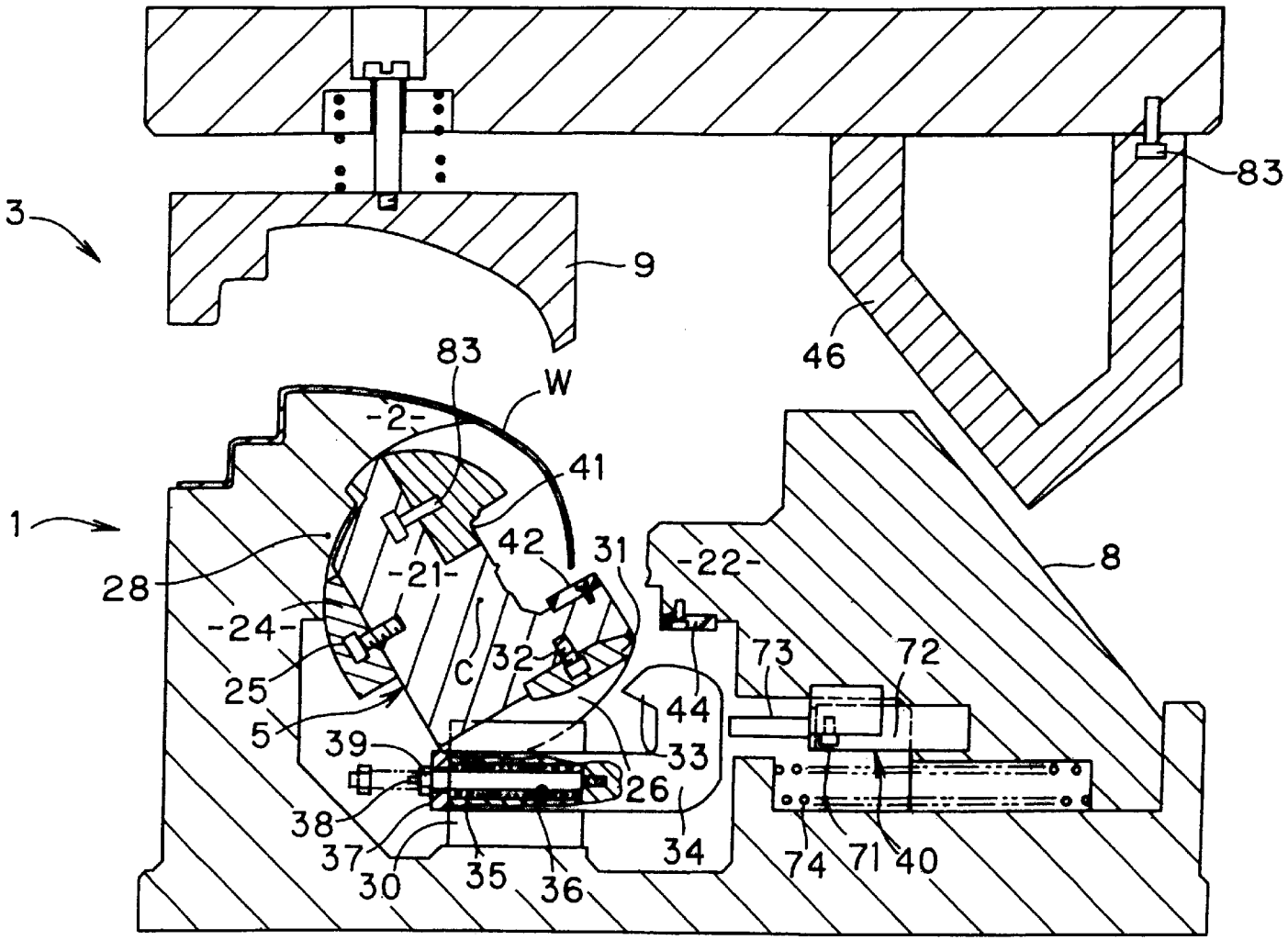

Referring now to FIG. 2, a lower die half 1 has an upper portion formed with a supporting portion 2 for the work W. The lower die half 1 rotatably supports a rotary cam 5, which has a side close to the supporting portion 2, formed with an intrusion forming portion for forming a recessed portion located inward of a stroke line of an upper die half 3. Code C indicates a center of pivoting movement of the rotary cam 5. In order to take the work W out of the lower die half 1 after the work W has been formed, the lower die half 1 is provided with an unillustrated automatic retractor such as an air cylinder.

The upper die half 3 is provided with a driving cam 46 and a pad 9 fixed to a base plate by a bolt 82.

The lower die half 1 is slidably provided with a slide cam 8 urged by a coil spring 74 in a direction away from the work W.

In order to maintain the rotary cam at a predetermined forming position thereby providing a high quality sheet-metal product, according to the present invention, at a time of the intrusion formation:

(1) The rotary cam is fixed by a lock bar;

(2) The rotary cam is engaged by the slide cam thereby fixed; and (3) The slide cam engaged with the rotary cam is contacted by a driving cam thereby fixing the rotary cam.

The shaft-like rotary cam 5 has two ends each provided with a supporting shaft extending therefrom. Each of the supporting shafts is rotatably fitted into a bearing 13, allowing the rotary cam 5 to pivot.

The rotary cam 5 is supported at its ends by the bearings as described above. If the rotary cam is directly contacted with the lower die half as in the prior art, accurate machining is required. However, since most portion of the rotary cam 5 is not directly contacted with the lower die half 1, machining of the rotary cam 5 and the lower die half 1 becomes easy.

The rotary cam 5 includes a rotary cam main body 21 serving as a core portion having; an upper portion provided with an intrusion forming portion 4 fixed by a bolt 83, a side portion provided with a pressing side-member 24 fixed by a bolt 25, and a bottom portion provided by a pivoting contact member 26. The pivoting contact member 26 contacts the lower die half 1. Also, the pressing side-member 24 contacts a backup portion 28 of the lower die half 1. With this arrangement, when the intrusion forming portion 4 of the rotary cam 5 and the intrusion forming portion 22 of the slide cam 8 press the work W, the backup portion 28 contacts the pressing side-member 24 thereby preventing the rotary cam 5 from deformation. By providing the backup portion 28, the deformation of the rotary cam 5 can be positively prevented, and it becomes possible to manufacture a high-quality sheet-metal formed product.

Figure 3:
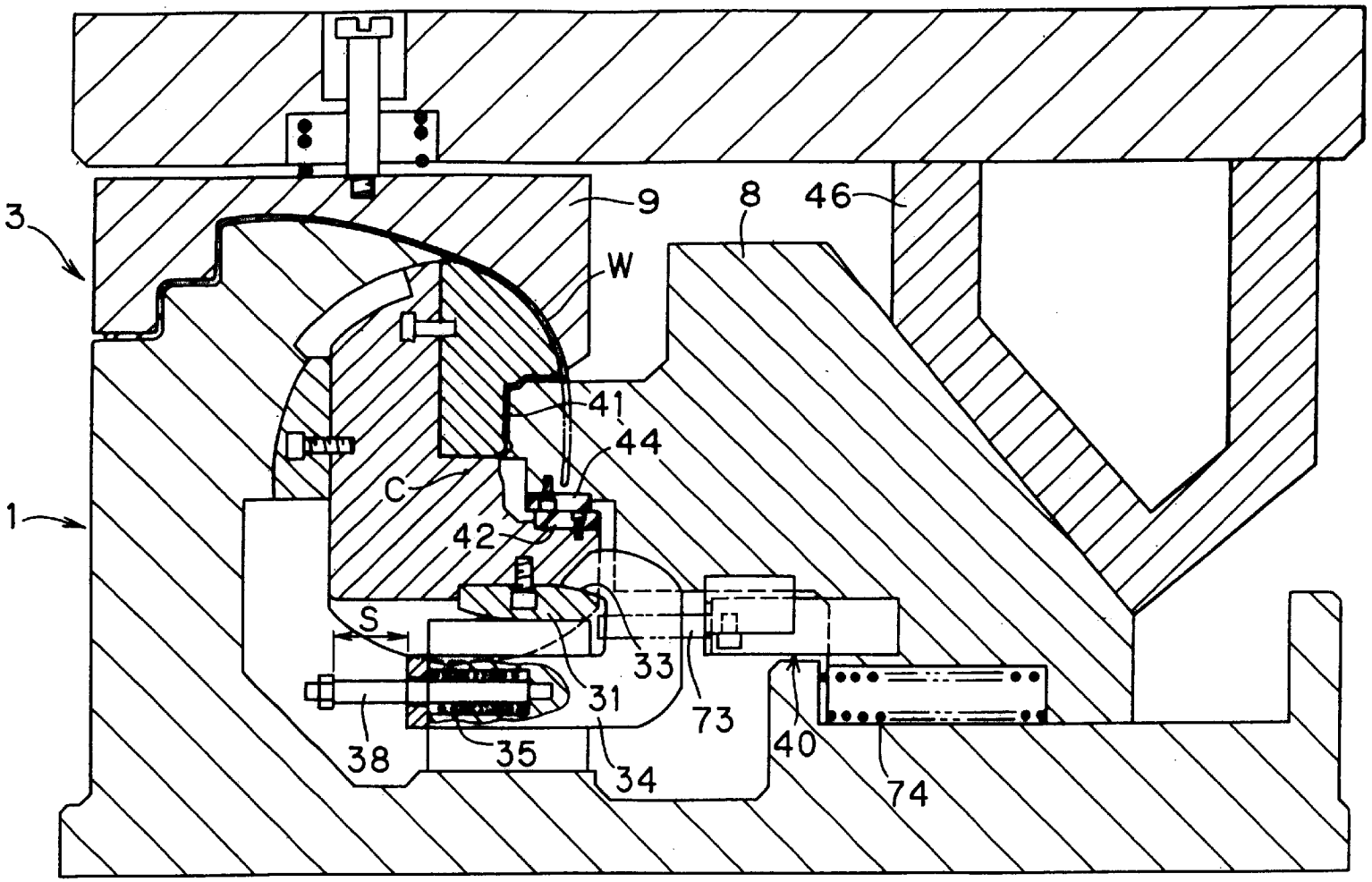

As shown in FIG. 2 and FIG. 3, a receiving portion is provided by fixing a receiving plate 31 with a bolt 32 to a lower portion of an intrusion forming portion 4 of the rotary cam 5. A J-shaped lock bar 34 having an engaging portion 33 for engagement with the receiving portion is slidably disposed in a guide 30 fixed to the lower die half 1 below the rotary cam 5. The lock bar 34 is urged in a direction away from the forming position by a coil spring 35 serving as a returning urge provider. The coil spring 35 is housed as compressed in a hole 36 formed at a rear end of the lock bar 34, seated on a seat plate 37 fixed to the guide 30, thereby urging the lock bar 34 toward the slide cam 8. The hole 36 is threaded by a stroke adjusting bolt 38 which projects out of the hole 36. The lock bar 34 is threaded by a nut 39 at a position which gives a desired stroke "S". The slide cam 8 is urged by a gas spring 40 serving as an urge provider providing an urge greater than the urge from the coil spring 35 serving as the returning urge provider. With this arrangement, the lock bar 34 can be urged in a direction of intrusion forming. When the intrusion forming is made to the work W by the slide cam 8 and the rotary cam 5, the lock bar 34 is moved against the urge from the coil spring 35 thereby engaging the rotary cam 5 with the lock bar 34.

The rotary cam 5 has an intrusion forming groove 41 opposed by a portion provided with a supporting plate 42 fixed by a bolt 43. The slide cam 8 has a portion to face the supporting plate 42, where a sliding plate 44 is fixed by a bolt 45.

FIG. 2 shows a state in which the upper die half 3 is in its upper dead center.

When the work W is placed on the supporting portion 2 of the lower die half 1, and the upper die half 3 is lowered, the driving cam 46 makes contact with the slide cam 5, rotating the slide cam 5 clockwise as in the figure thereby positioning the rotary cam 5 at a predetermined position. Thereafter, the pad 9 presses the work W.

With the lowering of the upper die half 3, the driving cam 46 also lowers, making the slide cam 8 leftward against the urge from the coil spring 74. The rotary cam 5 is brought to a predetermined posture for the intrusion forming by an unillustrated automatic retractor.

On the other hand, the gas spring 40 is fixed by a bolt at a portion opposing the lock bar 34. The gas spring 40 exerts a high and generally constant urging output over its entire stroke than does the coil spring 36.

The gas spring 40 is charged with a gas of a high pressure, at 150 kg/cm$^2$ for example, matched to an application, and provides a generally constant output of 150 kg/cm$^2$ for example, over an entire stroke of a rod 73 extending out of the cylinder 72 even if the rod is compressed. This is made possible by two tanks incorporated in the cylinder 72: When the rod 73 is compressed to pressurize one of the tanks, the high pressure gas in this tank flows out into the other tank, thereby maintaining a generally constant output over the entire stroke of the rod 73.

As has been described, differing from the coil spring, the gas spring 40 can provide a high output over its entire stroke, making possible to reliably move the lock bar 34.

Further, the gas spring 40 can move the slide cam 4 for a long distance such as 150 mm.

Gas spring 40 has a piston rod 73 that presses the lock bar 34 against the urge from the coil spring 36, moving the lock bar 34 leftward, engaging the engaging portion 33 of the lock bar 34 with the receiving plate 31 of the rotary cam 5, thereby positioning the rotary cam 5 right at a predetermined position, and making possible to provide a high-quality sheet-metal formed product.

Further, when the rotary cam 5 and the slide cam 8 performs the intrusion forming of the work W, the sliding plate 44 of the slide cam 8 contacts the supporting plate 42 of the rotary cam, bringing the slide cam 8 to fit into the intrusion forming groove 41 of the rotary cam, thereby positioning the rotary cam 5 accurately at the predetermined position, making possible to provide a high-quality sheet-metal formed product.

Further, the slide cam 8, which co-operates with the rotary cam 5 in the intrusion forming, is driven in contact with the driving cam of the upper die half 3, thereby positioning the rotary cam at the predetermined position, making possible to provide a high-quality sheet-metal formed product.

According to the present invention, the lock bar 34 locks the rotary cam 5, the slide cam 8 is engaged with thereby positioning the rotary cam 5, and further the slide cam 8 is pressed by the driving cam 46 for the positioning, making possible to provide a high-quality sheet-metal formed product.

The present invention provides, as has been described above, a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, the intrusion forming portion of the rotary cam having a lower portion formed with a receiving portion, a J-shaped lock bar having an engaging portion for engagement with the receiving portion being slidably disposed below the rotary cam, the lock bar being urged by a returning urge provider in a direction away from a forming direction, the slide cam being made capable of urging the lock bar in a direction of the intrusion forming by an urge provider providing an urge greater than the urge from the returning urge provider, for moving the lock bar against the urge from the returning urge provider thereby engaging the rotary cam with the lock bar at a time of the intrusion forming performed by the slide cam and the rotary cam. Therefore, the present invention has solved these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. According to the present invention, the rotary cam can be maintained at a predetermined forming attitude, and therefore it has become possible to provide a high-quality sheet metal formed product.

Further, according to the negative-angle forming die provided by the present invention, the rotary cam has an intrusion forming groove having an edge portion opposing the intrusion forming portion, formed with a supporting surface, and the slide cam is formed with a sliding surface for contact with the supporting surface at the time of the intrusion forming. Therefore, the present invention has solved these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. According to the present invention, the rotary cam can be maintained at a predetermined forming attitude, and therefore it has become possible to provide a high-quality sheet-metal formed product.

Further, according to the negative-angle forming die provided by the present invention, the upper die half is provided with a driving cam for driving the slide cam provided in the lower die half. Therefore, the present invention has solved these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. According to the present invention, the rotary cam can be maintained at a predetermined forming attitude, and therefore it has become possible to provide a high-quality sheet-metal formed product.

I claim:

1. A negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, the intrusion forming portion of the rotary cam having a lower portion formed with a receiving portion, a J-shaped lock bar having an engaging portion for engagement with the receiving portion being slidably disposed below the rotary cam, the lock bar being urged by a returning urge provider in a direction away from a forming direction, the slide cam being made capable of urging the lock bar in a direction of the intrusion forming by an urge provider providing an urge greater than the urge from the returning urge provider, for moving the lock bar against the urge from the returning urge provider thereby engaging the rotary cam with the lock bar at a time of the intrusion forming performed by the slide cam and the rotary cam.

2. The negative-angle forming die according to claim 1, wherein the rotary cam has an intrusion forming groove having an edge portion opposing the intrusion forming portion, formed with a supporting surface, the slide cam being formed with a sliding surface for contact with the supporting surface at the time of the intrusion forming.

3. The negative-angle forming die according to claim 1, wherein the upper die half is provided with a driving cam for driving the slide cam provided in the lower die half.

4. The negative-angle forming die according to claim 2, wherein the upper die half is provided with a driving cam for driving the slide cam provided in the lower die half.

5. A negative-angle forming die for forming sheet metal work, said die comprising:

A. a first die half carrying:

1. a supporting portion for placing a sheet metal work;
2. an intrusion forming portion;

B. an second die half movable toward the first die half;

C. a rotary cam journaled in the first die half; said rotary cam having a lock bar receiving plate;

D. a slide cam slidably opposed to the rotary cam, said slide cam having an intrusion forming portion;

E. a lock bar slidably carried by the first die half, said lock bar having:

1. an engaging portion for engaging the lock bar receiving plate of the rotary cam;
2. a returning urge provider, urging the lock bar away from the rotary cam;

wherein the work placed on the supporting portion of the first die half is formed by the intrusion forming portion of the rotary cam and the intrusion forming portion of the slide cam;

wherein the slide cam urges the lock bar toward the rotary cam with an urge greater than the urge of the returning urge provider, wherein the lock bar prevents rotation of the rotary cam while forming the sheet metal work.

* * * * *